United States Patent [19]

Shay

[11] 4,220,265

[45] Sep. 2, 1980

[54] PRESSURE FILLABLE DISPENSING DEVICE

[75] Inventor: Joseph J. Shay, Manchester, N.H.

[73] Assignee: Ethyl Corporation, Richmond, Va.

[21] Appl. No.: 13,090

[22] Filed: Feb. 21, 1979

[51] Int. Cl.[3] ..... B65D 83/00

[52] U.S. Cl. ..... 222/402.2; 222/402.24; 141/20

[58] Field of Search ..... 239/337; 141/3, 20; 222/394, 402.1, 402.13, 402.2, 402.24

[56] References Cited

U.S. PATENT DOCUMENTS

| | | | |
|---|---|---|---|
| 2,788,925 | 4/1957 | Ward | 222/394 |
| 2,856,103 | 10/1958 | Ward | 222/394 |
| 2,933,222 | 4/1960 | Waldherr | 222/402.2 |
| 2,968,427 | 1/1961 | Meshberg | 222/402.2 |
| 3,058,629 | 10/1962 | Gawthrop | 222/394 |
| 3,176,887 | 4/1965 | Potapenko et al. | 222/402.2 |

*Primary Examiner*—H. Grant Skaggs

*Attorney, Agent, or Firm*—Donald L. Johnson; John F. Sieberth; David L. Ray

[57] ABSTRACT

A dispensing device for a pressurized liquid container capable of delivering metered quantities of an aerosol composition having a discharge tube through which the container can be filled with fluids under pressure including a generally cylindrical chamber including an upper chamber and a generally cylindrical lower chamber, a discharge tube mounted in the sealed upper end of the chamber and extending into the chamber, the discharge tube being axially movable in the chamber and having a cup-shaped piston member connected thereto, the cup-shaped piston having a resilient rim slidable within the lower chamber when the discharge tube is depressed a predetermined amount to isolate a metered quantity of fluid within the upper chamber, the rim of the cup-shaped piston member being sufficiently resilient to allow fluids introduced under pressure through said discharge tube during filling of the container to flow between the rim and the side walls of the lower chamber.

16 Claims, 3 Drawing Figures

PRESSURE FILLABLE DISPENSING DEVICE

BACKGROUND OF THE INVENTION

The present invention is related to dispensing devices for aerosols and in particular to a metering valve for delivering metered quantities of an aerosol composition.

Aerosol compositions generally are of two kinds, namely those in which the composition contains a propellant liquid, which vaporizes very rapidly when the composition is at atmospheric pressure, and those in which the propulsion of the aerosol composition is effected by maintaining the liquid composition in a container under the pressure of a permanent gas, such as nitrogen.

The term "aerosol composition" as employed herein includes compositions other than simple liquids such as pastes, which may be discharged in the form of a coherent ribbon or stream, and viscous liquids which may be discharged in the form of a jet or a series of large drops and is not limited to compositions which are discharged in the form of the very minute droplets normally referred to as aerosols in the art to which the present invention relates.

Usually, the discharge tube will be provided with an actuator in the form of a nozzle member so constructed as to discharge the aerosol composition in the form of a jet, spray, or ribbon and to provide a conveniently shaped end part to which manual pressure can be applied to operate the valve.

Various prior constructions have been proposed for dispensing of metered quantities of aerosol compositions. Typical of such structures are those contained in U.S. Pat. Nos. 3,058,629; 2,856,103; and 2,788,925 which illustrate various metering valves of the prior art.

SUMMARY OF THE INVENTION

In accordance with the present invention there is provided a dispensing device for a pressurized liquid container capable of delivering metered quantities of an aerosol composition having a discharge tube through which the container can be filled with fluids under pressure including a generally cylindrical chamber including an upper chamber and a generally cylindrical lower chamber, a discharge tube mounted in the sealed upper end of the chamber and extending into the chamber, the discharge tube being axially movable in the chamber and having a cup-shaped piston member connected thereto, the cup-shaped piston having a laterally resilient rim slidable within the lower chamber when the discharge tube is depressed a predetermined amount to isolate a metered quantity of fluid within the upper chamber, the rim of the cup-shaped piston member being sufficiently resilient to allow fluids introduced under pressure through said discharge tube during filling of the container to flow between the rim and the side walls of the lower chamber.

DESCRIPTION OF THE PREFERRED EMBODIMENTS

Figure 1:
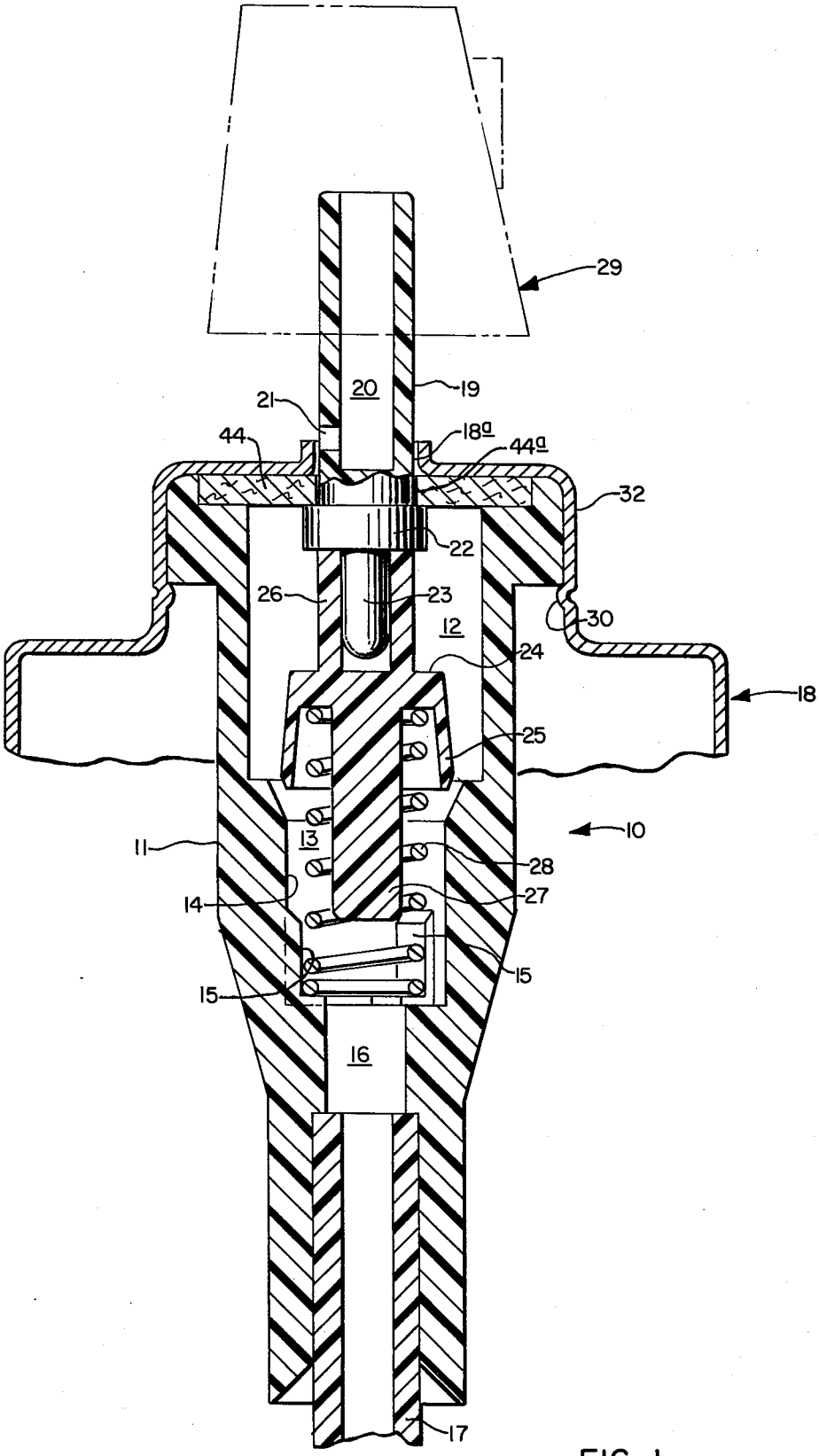
FIG. 1 is a partly cut-away, cross-sectional, elevational view of the dispensing device of the present invention in the non-dispensing mode.

Referring now to the drawings, in FIG. 1 is shown the dispensing device of the invention generally indicated by the numeral 10. The device includes a cylindrical member 11 which has a cylindrical upper chamber 12 therein and a generally cylindrical lower chamber 13 of smaller diameter than chamber 12, chamber 13 having side wall 14. Both upper chamber 12 and lower chamber 13 are generally cylindrical in shape and axially aligned.

Projecting from the side wall 14 of lower chamber 13 are a series of nibs 15 which extend axially down side wall 14. Immediately below lower chamber 13 is a tubular opening 16 which is axially aligned with dip tube 17. Dip tube 17 extends downwardly into the bottom of the container indicated generally by the numeral 18.

Located inside circular member 11 is discharge tube 19 which has hollow channel 20 inside and opening 21 in the side wall thereof. Shown "ghosted" to the top of discharge tube 19 is button 29 which is a conventional aerosol spray button. Discharge tube 19 extends through hole **44*a* in washer 44 and hole 18*a* in the top of container 18 has a skirt portion 22 at the lower end thereof, downwardly from which extends a pin 23. Skirt 22 strikes elastic washer 44 to limit the upper movement of discharge tube 20. Elastic washer 44 seals the upper end of upper chamber 12**.

Slidably connected to pin 23 is cup-shaped piston 24 having a laterally resilient rim 25. Pin 23 is slidably received in the hollow upper portion 26 of cup-shaped piston 24. Extending downwardly from cup-shaped piston 24 is pin 27 around which is loosely fitted spring 28.

Cylindrical chamber 11 is shown force-fitted in the upper neck portion 32 of container 18 and held in place by tab 30. Elastic washer 44 is fitted at the upper end of cylindrical member 11 in the neck 32 at the top end of upper chamber 12.

Figure 2:
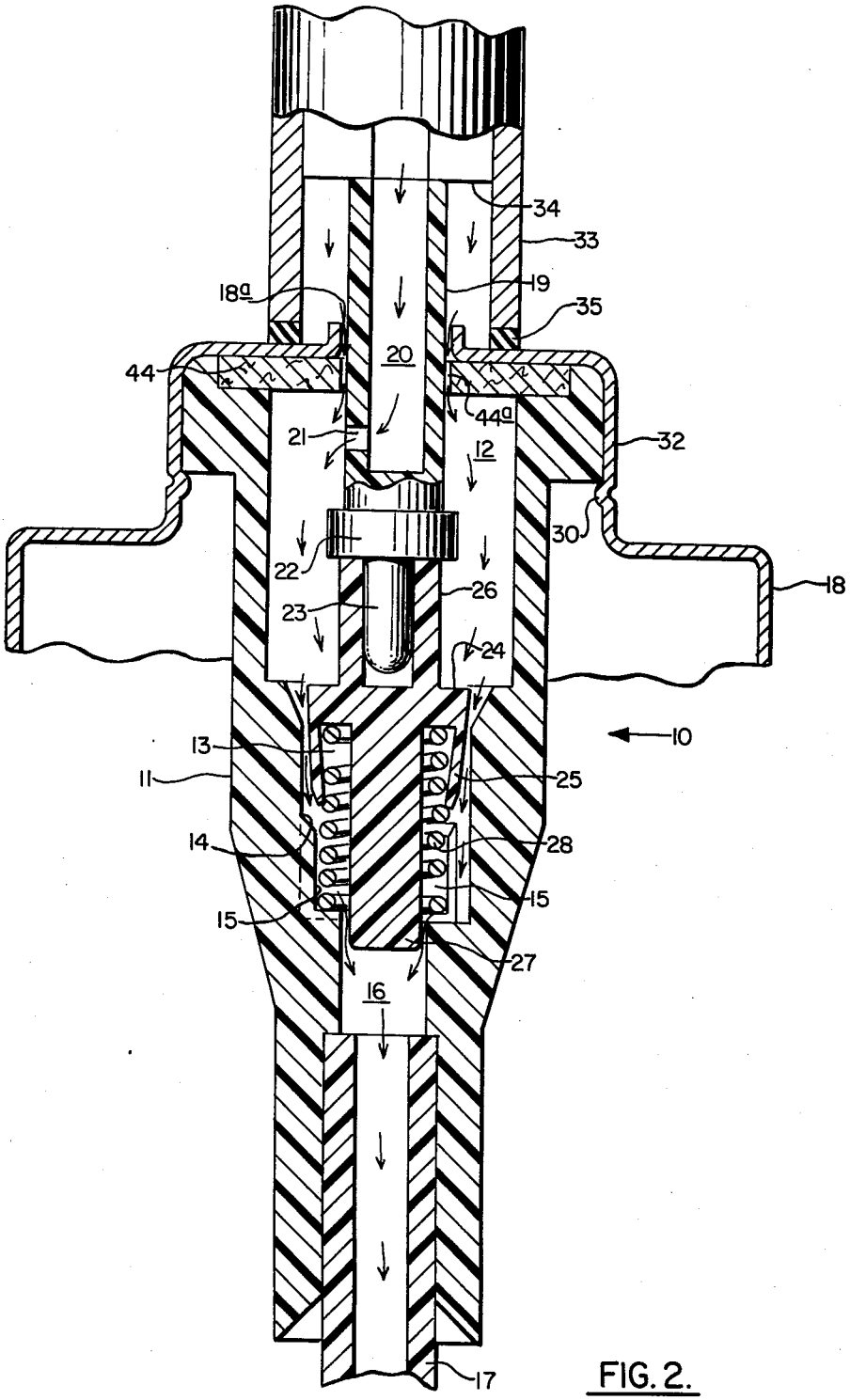
FIG. 2 is a partly cut-away, cross-sectional, elevational view of the dispensing device of the present invention while the device is being filled; and, FIG. 3 is a partly cut-away, cross-sectional, elevational view of the dispensing device of the present invention while the device is being filled.

To fill the dispensing device of the invention, a filling tube 33 shown in FIG. 2 containing liquids or fluids under pressure, is forced onto discharge tube 19 after button 29 has been removed therefrom. A flat portion 34 inside of tube 33 contacts discharge tube 29 forcing it downward to the position shown in FIG. 2. Tube 29 can also be forced down by hydraulic pressure of the fluids being forced into container 18. A seal or gasket 35 is provided around the lower end of filling tube 33 to make a sealing contact with the container 18.

Figure 3:
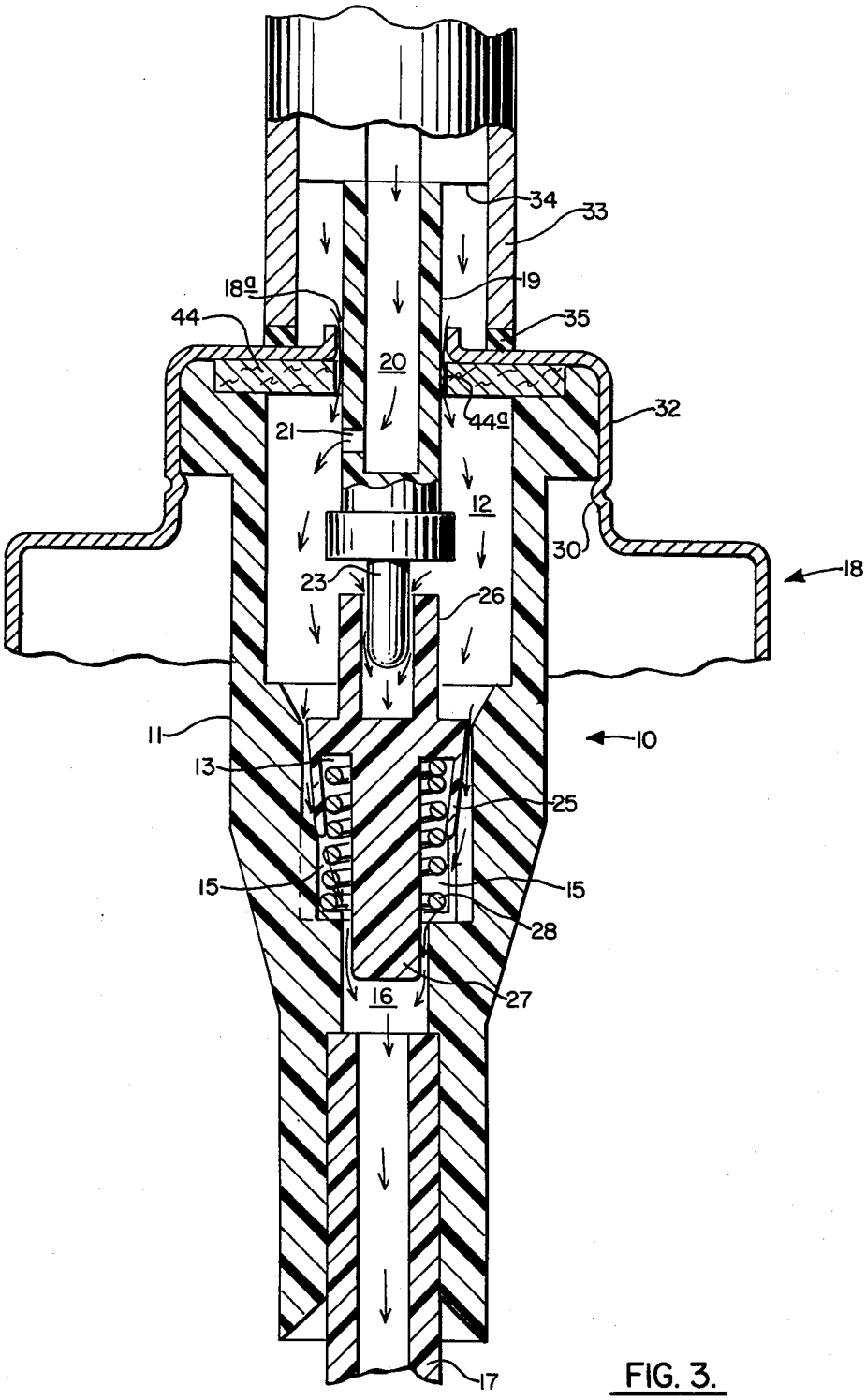

The flow of fluids under pressure is indicated by the arrows in FIG. 2. The fluids flow downwardly through discharge tube 19 and outwardly through opening 21 into upper chamber 12. By properly dimensioning the interference fit between washer 44 and the discharge tube 19, fluids could also flow between tube and washer during pressure filling. Due to the pressure of the fluids entering container 18, rim 25 is deformed as shown in FIG. 2 and fluids flow therearound into opening 16 and downward through dip tube 17 to fill the container. As shown in FIG. 3, if a sufficiently loose fit is provided between pin 23 and the upper portion 26 of piston 24 and the pressure of the liquids flowing from filling tube 33 is sufficiently great, the cup-shaped piston 24 slides downwardly from pin 23 causing the rim 25 of cup-shaped piston 24 to strike nibs 15 and cause mechanical deformation of the rim to allow fluids to flow therearound.

To operate the device of the present invention, the button 29 is depressed thereby lowering opening 21 beneath elastic washer 44 and causing rim 25 to contact the side wall 14 of lower chamber 13. When the rim 25 contacts the side wall 14, the fluids in chamber 12 are isolated from the fluids beneath cup-shaped piston 24 thus isolating a metered charge of fluids in chamber 12. When vent 21 then is lowered below washer 44 the fluids within upper chamber 12 exit through opening 21 into chamber 20 and upwardly to button 29. It will be noted that, as would be obvious to those of ordinary skill in the art, rim 25 establishes a sealing contact with side wall 14 of reduced diameter section 13 prior to opening 21 passing beneath washer 44.

Upon release of the button 29, opening 21 first rises to reseal in elastic washer 44 and causes rim 25 to lose contact with side wall 14 allowing fluids to refill chamber 12 in preparation for the next cycle.

Having fully described the invention, it is desired that it be limited only within the spirit and scope of the attached claims.

I claim:

1. A dispensing device for a pressurized liquid container capable of delivering metered quantities of an aerosol composition having a discharge tube through which the container can be filled with fluids under pressure comprising:

a. a generally cylindrical chamber including an upper chamber and a lower chamber, said generally cylindrical chamber being adapted to be sealed into a neck of said container, said upper chamber being closed at the upper end with respect to said container by seal means;

b. discharge tube means mounted in said seal means and extending therethrough into said generally cylindrical chamber, said discharge tube being resiliently biased toward the upper end of said upper chamber and being movable axially in said generally cylindrical chamber; and, c. a cup-shaped piston member connected to said discharge tube with its open end towards the lower end of said lower chamber, said cup-shaped piston member having a laterally resilient rim with the entire periphery thereof sliding directly against the side wall of said lower chamber when said discharge tube is depressed a predetermined amount to isolate a metered quantity of fluid within said upper chamber, said rim of said cup-shaped piston member being sufficiently resilient to allow fluids introduced under pressure through said discharge tube during filling of said container to flow between said rim and said side wall of said lower chamber, said lower chamber having a plurality of nibs connected to said side wall of said lower chamber for mechanically deflecting said rim inwardly.

2. The device of claim 1 wherein said discharge tube has a skirt at the lower end thereof which strikes said seal means to limit the upward movement of said discharge tube.

3. The device of claim 2 wherein said skirt has a pin rigidly connected thereto which extends downwardly from said discharge tube means and is slidably received in a hollow upper section of said cup-shaped piston.

4. The device of claim 3 wherein said discharge tube has an opening means in the side wall thereof for conveying liquids into and out of the interior of said discharge tube.

5. The device of claim 1 wherein a compression spring is mounted in said lower chamber beneath said cup-shaped piston member for biasing said cup-shaped piston member upwardly.

6. The device of claim 1 wherein said seal means is an elastic sealing washer.

7. A dispensing device for a pressurized fluid container capable of delivering metered quantities of an aerosol composition having a discharge tube through which the container can be filled with fluids under pressure comprising:

a. a generally cylindrical chamber including an upper chamber and a lower chamber, said generally cylindrical chamber being adapted to be sealed into a neck of said container, said upper chamber being closed at the upper end with respect to said container by seal means;

b. discharge tube means mounted in said seal means and extending therethrough into said generally cylindrical chamber, said discharge tube being resiliently biased toward the upper end of said upper chamber and being movable axially in said generally cylindrical chamber; and, c. a cup-shaped piston member connected to said discharge tube with its open end towards the lower end of said lower chamber, said cup-shaped piston member having a laterally resilient rim with the entire periphery thereof sliding directly against the side wall of said lower chamber when said discharge tube is depressed a predetermined amount to isolate a metered quantity of fluid within said upper chamber, said rim of said cup-shaped piston member being sufficiently resilient to allow fluids introduced under pressure through said discharge tube during filling of said container to flow between said rim and said side wall of said lower chamber, said discharge tube having a skirt at the lower end thereof which strikes said seal means to limit the upward movement of said discharge tube, said skirt having a pin rigidly connected thereto which extends downwardly from said discharge tube means and is slidably received in a hollow upper section of said cup-shaped piston.

8. The device of claim 7 wherein said lower chamber has means connected thereto for mechanically deflecting said rim inwardly.

9. The device of claim 8 wherein said means for deflecting said rim comprises a plurality of nibs connected to said side wall of said lower chamber.

10. The device of claim 7 wherein a compression spring is mounted in said lower chamber beneath said cup-shaped piston member for biasing said cup-shaped piston member upwardly.

11. The device of claim 7 wherein said seal means is an elastic sealing washer.

12. The device of claim 7 wherein said lower chamber has nibs connected to the side wall thereof for mechanically deflecting said rim inwardly, said discharge tube having an opening in the side wall thereof for conveying liquids into and out of the interior of said discharge tube.

13. The device of claim 12 wherein a compression spring is mounted in said lower chamber for biasing said cup-shaped piston member upwardly and said seal means is an elastic sealing washer.

14. The device of claim 7 wherein said discharge tube has an opening means in the side wall thereof for conveying liquids into and out of the interior of said discharge tube.

15. A dispensing device for a pressurized liquid container capable of delivering metered quantities of an aerosol composition having a discharge tube through which the container can be filled with fluids under pressure comprising:

a. a generally cylindrical chamber including an upper chamber and a lower chamber, said generally cylindrical chamber being adapted to be sealed into a neck of said container, said upper chamber being closed at the upper end with respect to said container by seal means;

b. discharge tube means mounted in said seal means and extending therethrough into said generally cylindrical chamber, said discharge tube being resiliently biased toward the upper end of said upper chamber and being movable axially in said generally cylindrical chamber; and, c. a cup-shaped piston member connected to said discharge tube with its open end towards the lower end of said lower chamber, said cup-shaped piston member having a laterally resilient rim with the entire periphery thereof sliding directly against the side wall of said lower chamber when said discharge tube is depressed a predetermined amount to isolate a metered quantity of fluid within said upper chamber, said rim of said cup-shaped piston member being sufficiently resilient to allow fluids introduced under pressure through said discharge tube during filling of said container to flow between said rim and said side wall of said lower chamber, said lower chamber having nibs connected to the side wall thereof for mechanically deflecting said rim inwardly, said discharge tube having a skirt at the lower end which strikes said seal means to limit the upward movement of said discharge tube, said discharge tube having an opening in the side wall thereof for conveying liquids into and out of the interior of said discharge tube.

16. The device of claim 15 wherein said skirt has a pin rigidly connected thereto which extends down from said discharge tube means and is slidably received in a hollow upper section of said cup-shaped piston, a compression spring is mounted in said lower chamber for biasing said cup-shaped piston member upwardly, and said seal means is an elastic sealing washer.

* * * * *

UNITED STATES PATENT AND TRADEMARK OFFICE

CERTIFICATE OF CORRECTION

PATENT NO. : 4,220,265

DATED : September 2, 1980

INVENTOR(S) : Joseph J. Shay

It is certified that error appears in the above—identified patent and that said Letters Patent is hereby corrected as shown below:

Title Page, [73] Assignee: reads "Ethyl Corporation" should read -- Ethyl Products Company --. Column 4, line 11, (Claim 7), reads "fluid", should read -- liquid --.

Signed and Sealed this

*Eighth* Day of *June 1982*

[SEAL]

*Attest:*

GERALD J. MOSSINGHOFF

*Attesting Officer*

*Commissioner of Patents and Trademarks*